US009383155B2

(12) United States Patent
Bero

(10) Patent No.: US 9,383,155 B2
(45) Date of Patent: Jul. 5, 2016

(54) COMPACT SURVIVAL FIREARM

(71) Applicant: Tim Shawn Bero, Vernonia, OR (US)

(72) Inventor: Tim Shawn Bero, Vernonia, OR (US)

( * ) Notice: Subject to any disclaimer, the term of this patent is extended or adjusted under 35 U.S.C. 154(b) by 0 days.

(21) Appl. No.: 14/636,151

(22) Filed: Mar. 2, 2015

(65) Prior Publication Data

US 2016/0010937 A1 Jan. 14, 2016

Related U.S. Application Data

(63) Continuation of application No. 14/011,234, filed on Aug. 27, 2013, now Pat. No. 9,003,684.

(51) Int. Cl.
*F41A 21/48* (2006.01)
*F41A 3/66* (2006.01)
*F41A 11/00* (2006.01)

(52) U.S. Cl.
CPC . *F41A 21/48* (2013.01); *F41A 3/66* (2013.01); *F41A 11/00* (2013.01)

(58) Field of Classification Search
CPC ..... F41A 21/00; F41A 21/48; F41A 21/481; F41A 21/484; F41A 21/487; F41A 11/00; F41A 3/66
USPC ..... 42/75.01, 75.02, 76.01, 77
See application file for complete search history.

(56) References Cited

U.S. PATENT DOCUMENTS 2,625,766 A * 1/1953 Simpson ..... F41A 5/18 42/75.02
3,134,174 A 5/1964 Gagnier
3,771,415 A 11/1973 Into et al.
4,057,924 A 11/1977 Joseph
5,325,617 A 7/1994 Vojta et al.
6,250,198 B1 * 6/2001 Vendetti ..... F41A 21/08 42/75.02
6,655,372 B1 * 12/2003 Field ..... F41B 11/00 124/83
7,415,790 B1 8/2008 Ruhland et al.
8,701,326 B2 * 4/2014 Zonshine ..... F41A 21/10 42/77
2003/0029070 A1 2/2003 Dowding
2004/0244258 A1 * 12/2004 O'Dwyer ..... F41A 9/35 42/77
2007/0199435 A1 8/2007 Hochstrate et al.
2008/0066361 A1 * 3/2008 Aalto ..... F41A 21/485 42/76.01
2011/0185618 A1 * 8/2011 Jamison ..... F41A 21/00 42/75.03
2012/0017483 A1 * 1/2012 Vuksanovich ..... F41A 21/48 42/75.02
2012/0180354 A1 * 7/2012 Sullivan ..... F41A 3/26 42/16
2014/0115938 A1 * 5/2014 Jarboe ..... F41A 21/485 42/71.01

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

A compact survival firearm is a rifle with removable barrel having a frame defining a passage having a forward open aperture, a barrel having a breech end portion received in the frame, and having a forward portion extending forward of the aperture, the barrel having a rear end support portion adapted to be closely received in the frame passage such that is it laterally constrained by the frame, and the barrel having an intermediate support portion spaced apart from the rear end support portion and adapted to be selectably connected to an intermediate support portion of the frame, such that barrel is supported at spaced apart locations to provide stability. The rear end support portion and the intermediate support portion may be spaced apart by an elongated necked-down portion of the barrel having a smaller diameter than the rear end support portion and the intermediate support portion.

19 Claims, 16 Drawing Sheets

COMPACT SURVIVAL FIREARM

CROSS-REFERENCE TO RELATED APPLICATION

This is a continuation of U.S. patent application Ser. No. 14/011,234, entitled "COMPACT SURVIVAL FIREARM," filed Aug. 27, 2013.

FIELD OF THE INVENTION

The present invention relates to firearms, and more particularly to a light weight firearm that can be easily adjusted to compensate for loosening of the mating engagement between the upper receiver and the lower receiver.

BACKGROUND OF THE INVENTION

Compact firearms are desirable for outdoor activities, particularly those occurring in remote areas, including backpacking, boating, camping, backcountry flying, mountain biking, and hunting. A compact rifle is particularly attractive relative to a pistol because of the rifle's increased accuracy and range.

Since the compact firearm is often carried on the body, low weight is also desirable in addition to the ability to fit in a small space. Aluminum and plastic are attractive materials because of their light weight and low cost. However, a firearm made out of aluminum or plastic has the risk of apertures stretching over time from discharge impulses and denting caused by wear. In the case of an aluminum or plastic rifle, the mating engagement between the upper receiver and the lower receiver can become loose over time or as a result of subsequent firearm manufacturing activities after the receivers are initially made. Any looseness can lead to worsening accuracy over time and a perception of the firearm having poor quality on the part of the user.

Therefore, a need exists for a new and improved compact survival firearm that can be easily adjusted to compensate for loosening of the mating engagement between the upper receiver and the lower receiver. In this regard, the various embodiments of the present invention substantially fulfill at least some of these needs. In this respect, the compact survival firearm according to the present invention substantially departs from the conventional concepts and designs of the prior art, and in doing so provides an apparatus primarily developed for the purpose of enabling easy adjustment to compensate for loosening of the mating engagement between the upper receiver and the lower receiver.

SUMMARY OF THE INVENTION

The present invention provides an improved compact survival firearm, and overcomes the above-mentioned disadvantages and drawbacks of the prior art. As such, the general purpose of the present invention, which will be described subsequently in greater detail, is to provide an improved compact survival firearm that has all the advantages of the prior art mentioned above.

To attain this, the preferred embodiment of the present invention essentially comprises an upper receiver body, a lower receiver body removably connectable to the upper receiver body and defining a transverse bore adapted to closely receive a takedown pin, a fastener connected to the upper receiver body and having a protruding portion protruding therefrom, the lower receiver body defining a space sized to closely receive the fastener, the protruding portion of the fastener having an end portion of a first width, and an intermediate portion of a second width less than the first width, and the space at least partially intersecting the transverse bore such that the intermediate portion of the fastener is clear of the bore to permit the presence of the takedown pin, and the end portion of the fastener prevents separation of the upper receiver from the lower receiver when a takedown pin is present in the bore. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
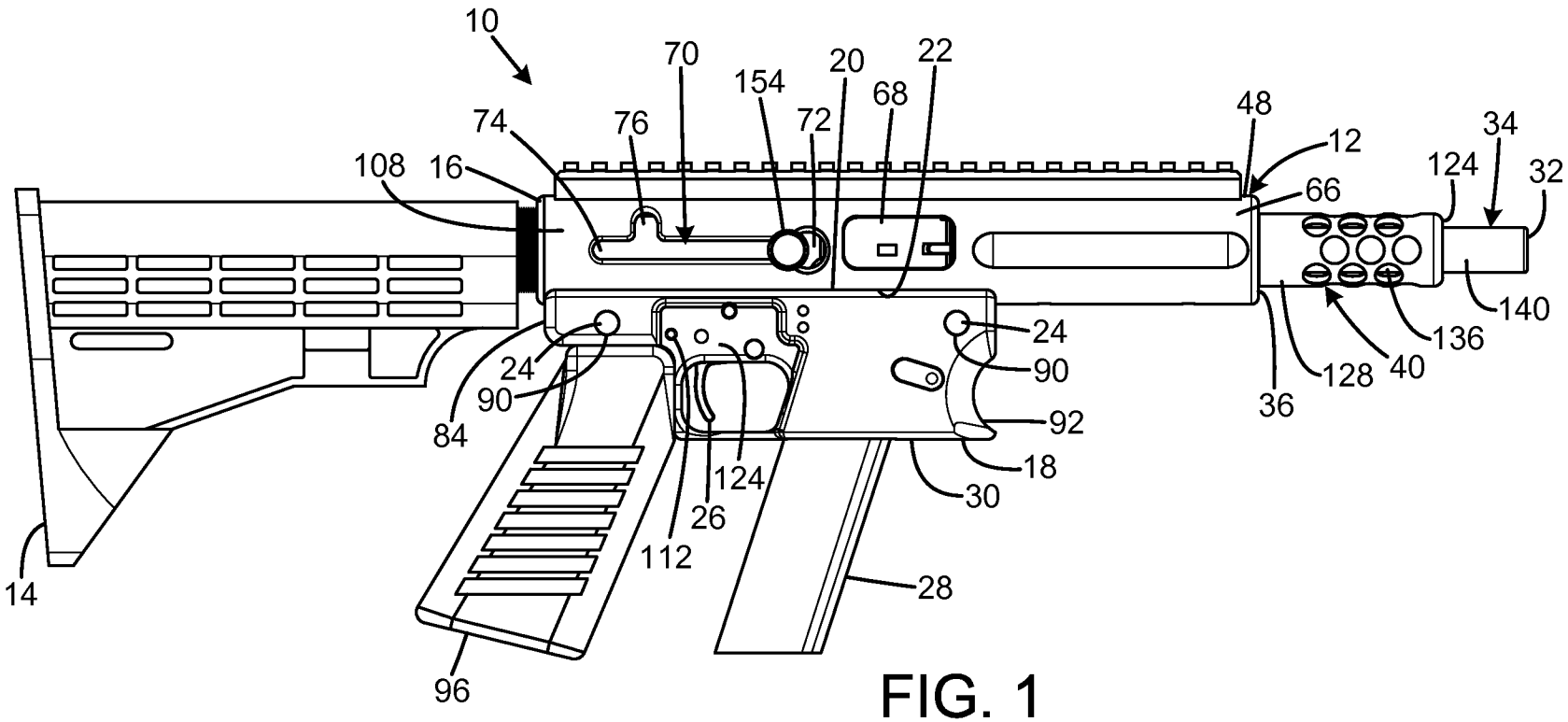
FIG. 1 is a right side view of the current embodiment of the compact survival firearm constructed in accordance with the principles of the present invention.

An embodiment of the compact survival firearm of the present invention is shown and generally designated by the reference numeral 10.

FIG. 1 illustrates the improved compact survival firearm 10 of the present invention. More particularly, the firearm is a rifle having an upper receiver 12 with a stock or buffer assembly 14 extending rearward from the rear 16 of the upper receiver. A lower receiver 18 has a top 20 that is removably connected to the bottom 22 of the upper receiver by two receiver cross pins 24. A trigger 26 and a magazine 28 extend downwardly from the bottom 30 of the lower receiver. In the current embodiment, both the upper and lower receivers are made of aluminum or plastic. The bottom 30 rear 94 of the lower receiver has a facility 110 (shown in FIGS. 2-4) adapted to receive a grip 96.

The muzzle 32 end of a barrel 34 extends forwardly from the front 36 of the upper receiver 12. The barrel has a central bore 38 (shown in FIG. 11). A barrel nut 40 encircles the barrel, and the barrel nut abuts the front of the upper receiver.

Figure 2:
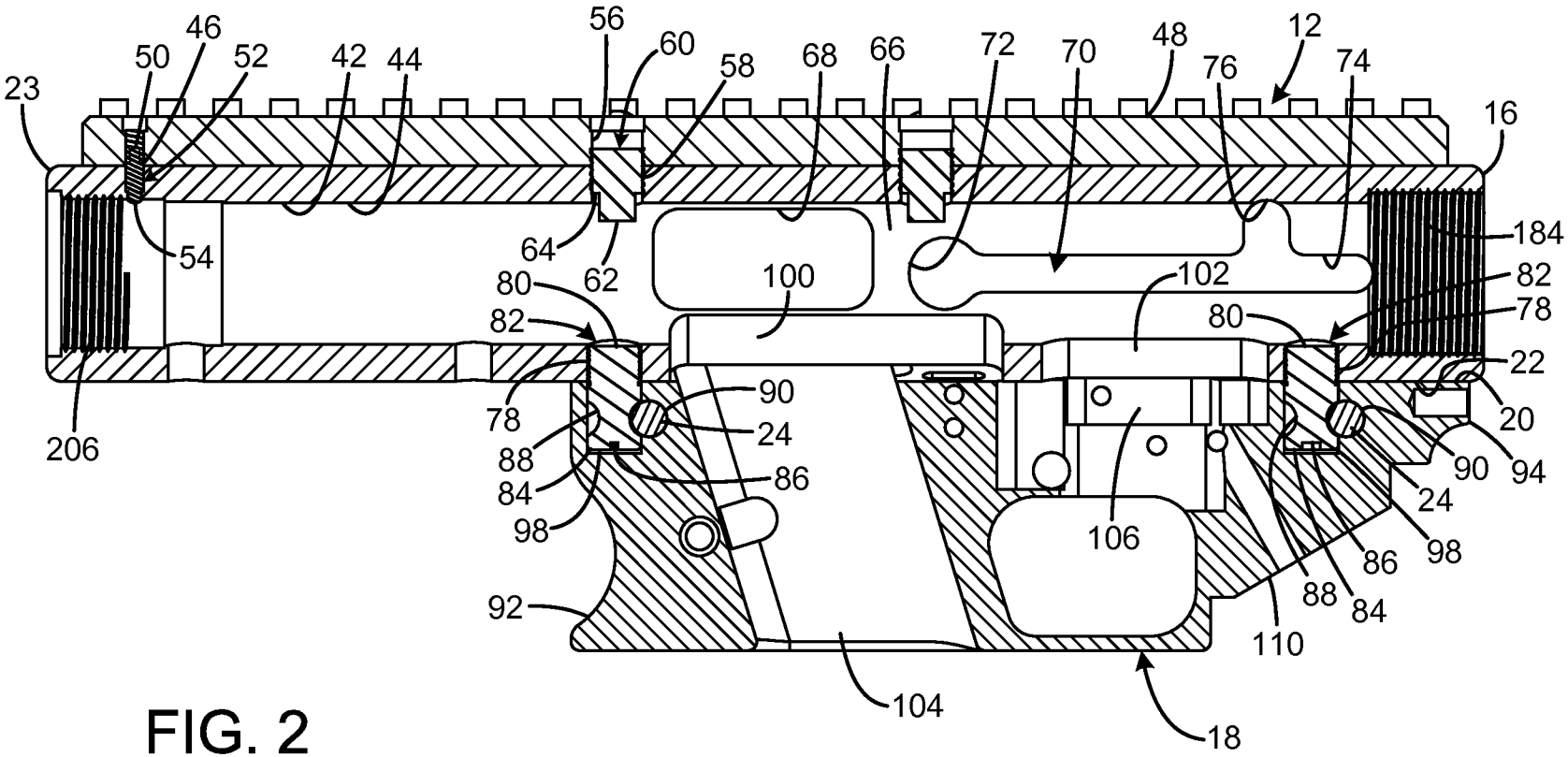
FIG. 2 is a left side sectional view of the current embodiment of the upper and lower receivers of FIG. 1 removed from the firearm.
Figure 3:
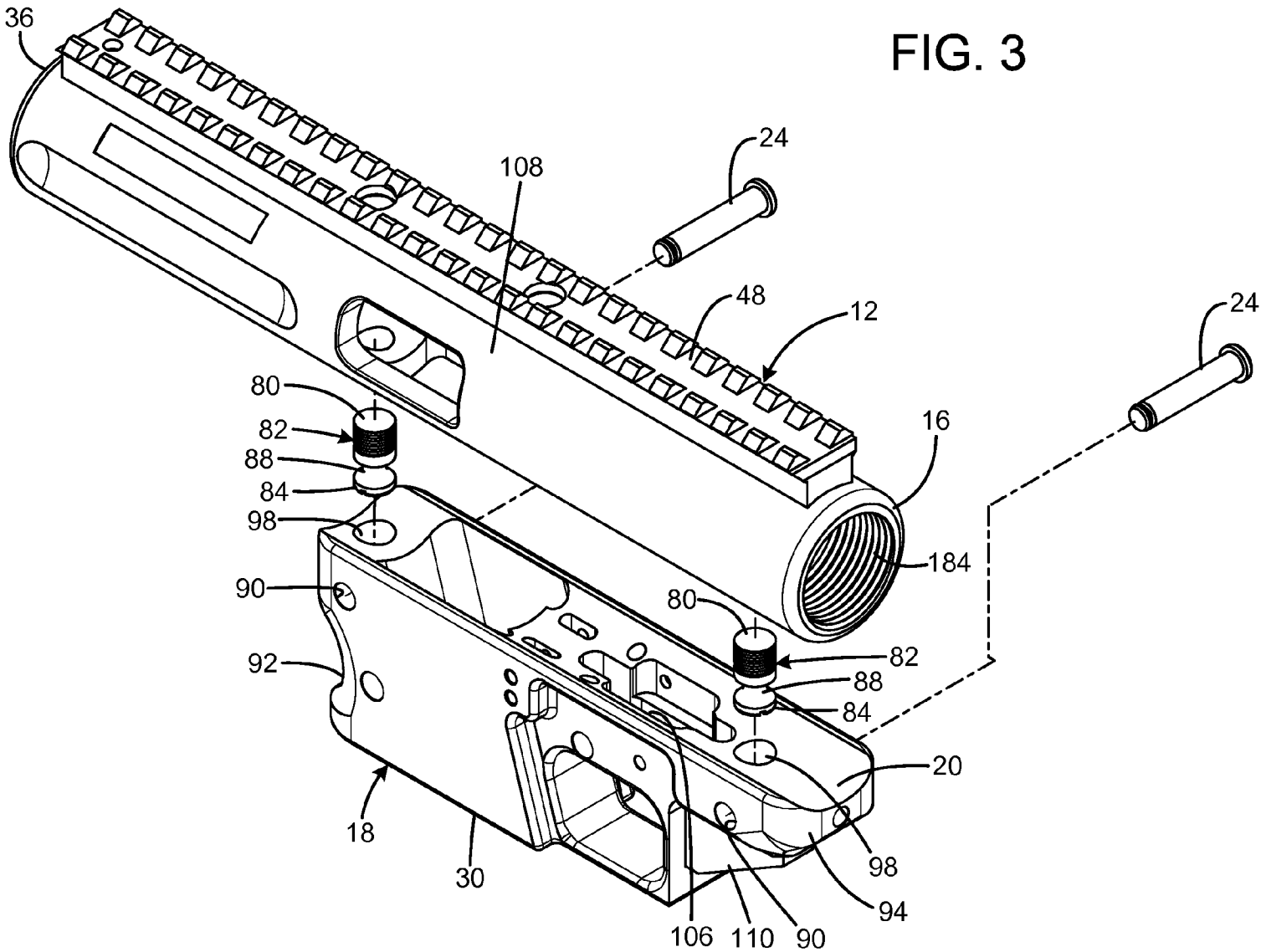
FIG. 3 is a top rear isometric view of the current embodiment of the upper and lower receivers of FIG. 1 removed from the firearm.
Figure 4:
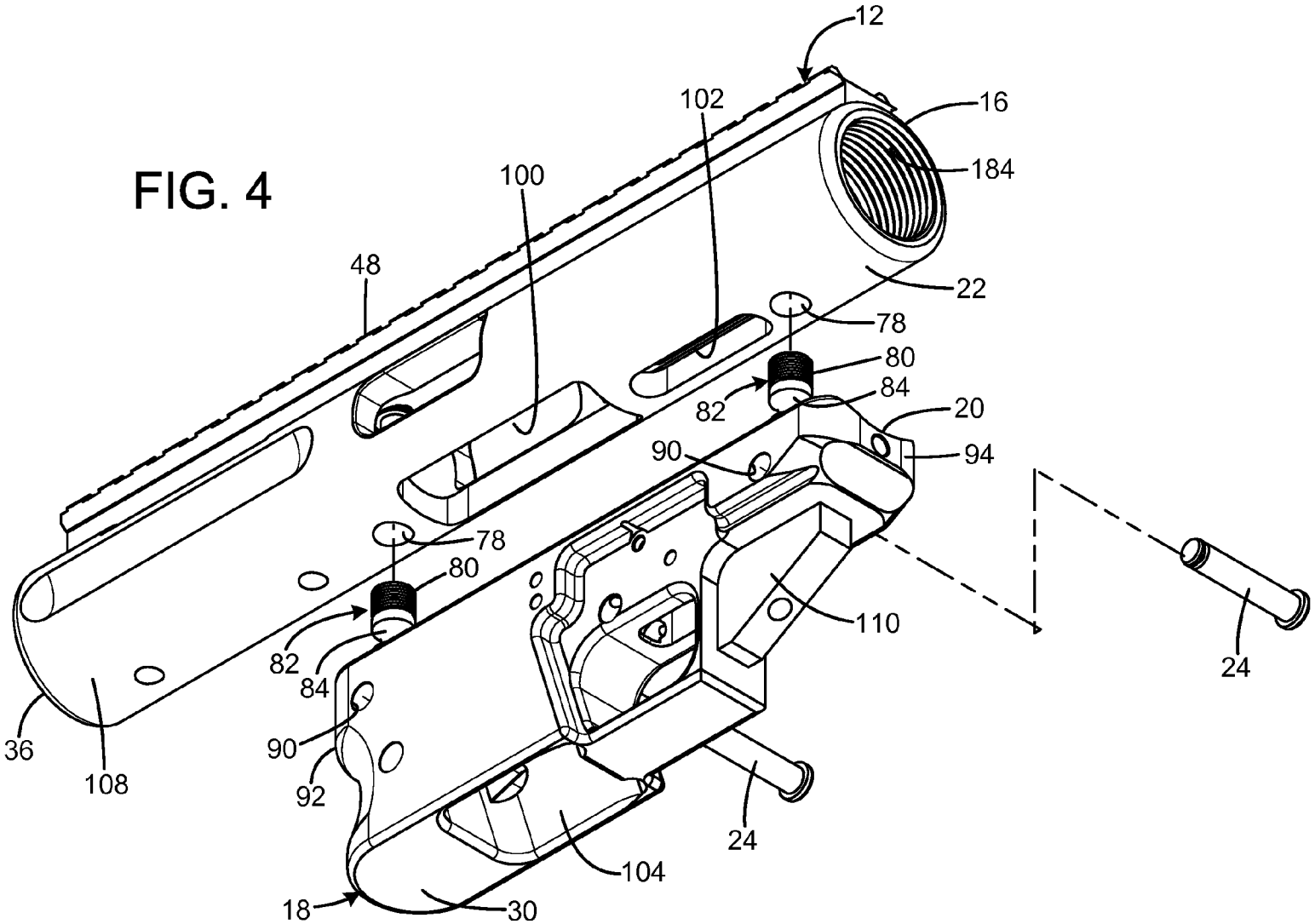
FIG. 4 is a bottom rear isometric view of the current embodiment of the upper and lower receivers of FIG. 1 removed from the firearm.
Figure 5:
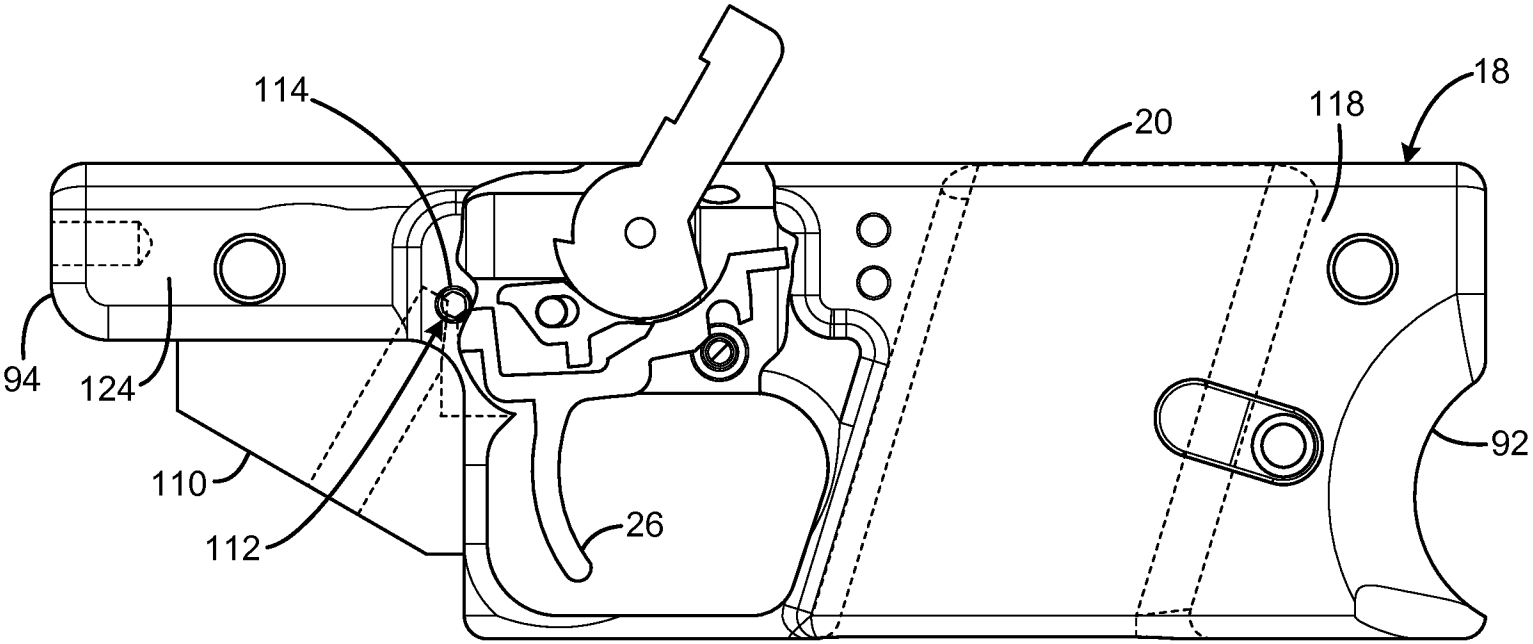
FIG. 5 is a right side view of the current embodiment of the lower receiver of FIG. 1 removed from the firearm with the child safety lock in the locked position.
Figure 6:
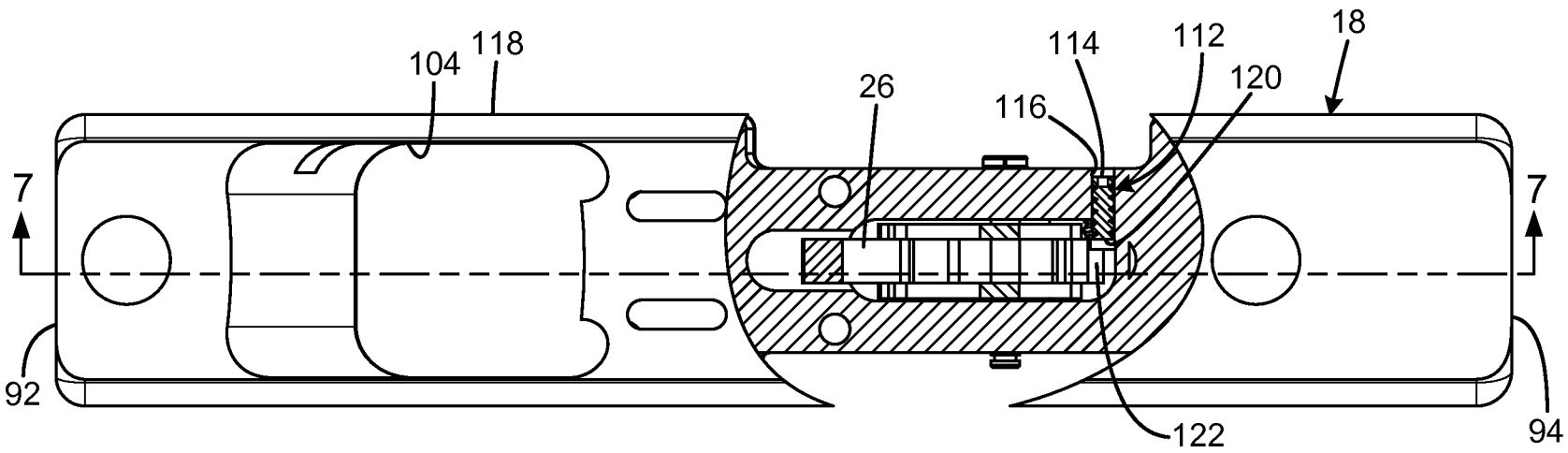
FIG. 6 is a top view of the current embodiment of the lower receiver of FIG. 1 removed from the firearm with a portion of the top cutaway and the child safety lock in the locked position.
Figure 7:
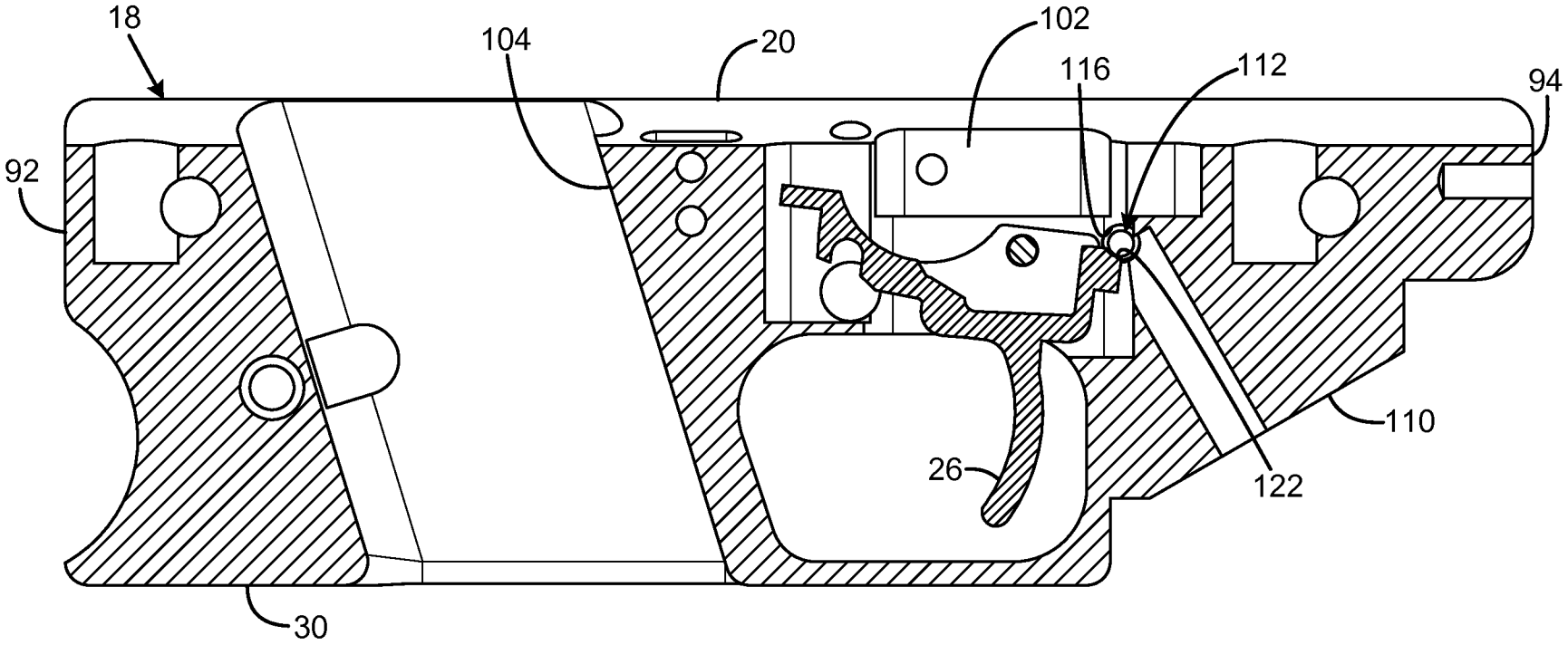
FIG. 7 is a left side sectional view of the current embodiment of the lower receiver of FIG. 1 removed from the firearm with the child safety lock in the locked position.
Figure 8:
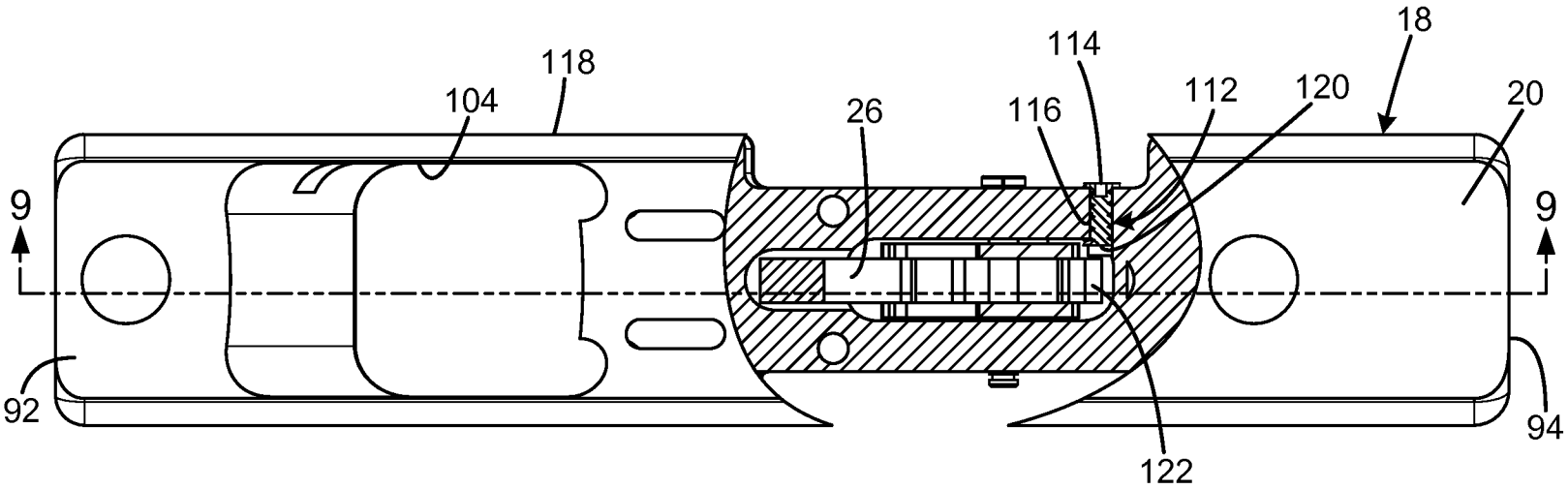
FIG. 8 is a top view of the current embodiment of the lower receiver of FIG. 1 removed from the firearm with a portion of the top cutaway and the child safety lock in the unlocked position.
Figure 9:
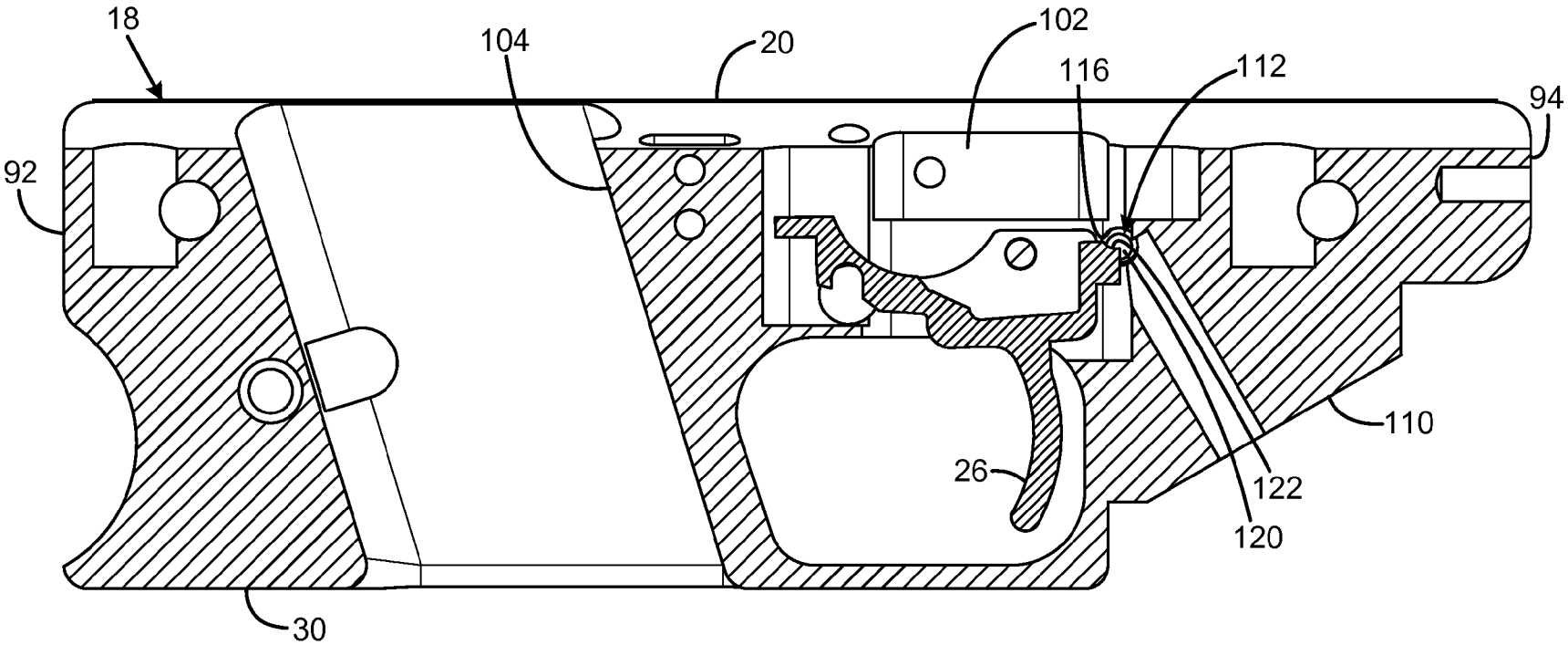
FIG. 9 is a left side sectional view of the current embodiment of the lower receiver of FIG. 1 removed from the firearm with the child safety lock in the unlocked position.

FIGS. 2-4 illustrate the improved upper receiver 12 and lower receiver 18 of the present invention. More particularly, the upper and lower receivers have been removed from the firearm 10. The upper receiver has a central bore 42 that defines an interior surface 44. The interior surface adjacent to the front 36 has threads 206, and the interior surface adjacent to the rear 16 has threads 184.

A bore 46 in communication with the central bore 42 is located at the top 48 of the upper receiver 12 immediately rearward of the threads 206. The bore 46 receives a spring 50 and a barrel nut detent 52. The spring urges the barrel nut detent inwards such that a forward portion 54 of the barrel nut detent penetrates the central bore 42.

A threaded bore 56 in communication with the central bore 42 is located at the top 48 of the upper receiver rearward of the bore 46. The bore 56 threadedly receives the threaded portion 58 of a barrel stop 60. The barrel stop has a forward portion 62 that is of a smaller diameter than the threaded portion 58, which creates a shoulder 64. At least a portion of the forward portion 62 penetrates the central bore 42. The amount of the forward portion 62 that enters the central bore is determined by the extent to which the barrel stop is screwed into the threaded bore 56. In the current embodiment, the barrel stop is made of hardened steel to prevent wear.

The right side 66 of the upper receiver 12 defines an ejection port 68 and a cocking handle slot 70 that communicate with the central bore 42. The forward portion 72 of the cocking handle slot is enlarged and curved. The rearward portion 74 of the cocking handle slot includes an upward opening 76.

The bottom 22 of the upper receiver 12 has two threaded bores 78. Each bore 78 receives the threaded end 80 of a receiver attach screw 82. The head 84 of each receiver attach screw has a free end face with a slot 86 for engagement by a screwdriver. Each receiver attach screw has a curved toroidal neck 88 that is semicircular in cross-section located between the head and the threaded end. The neck has a reduced diameter/width compared to the remainder of the receiver attach screw. The position of the curved neck of each receiver attach screw and the amount the curved neck protrudes is determined by the extent to which the threaded end is screwed into the corresponding bore 78. Two elongate apertures 100 and 102 interface with the magazine well 104 and trigger aperture 106 in the top 20 of the lower receiver 18. In the current embodiment, the magazine well is adapted to receive a standard Glock® pistol magazine.

The top 20 of the lower receiver 18 forms a cylindrical cradle surface that closely abuts the cylindrical exterior surface 108 of the tubular upper receiver 12. The lower receiver 18 has two lateral or transverse bores 90 adjacent to the front 92 and rear 94 near the top 20. The bores 90 are each in communication with a pocket 98 in the top of the lower receiver that at least partially intersects a corresponding bore, but are offset to one side. In the current embodiment, the pockets are cylindrical bores. Each bore 90 receives a cross pin or takedown pin 24.

When the lower receiver 18 is mated to the upper receiver 12, each pocket 98 receives the protruding cylindrical head 84 and curved neck 88 of one of the receiver attach screws 82 attached to the upper receiver 12. Then, a cross pin 24 is inserted into each of the bores 90. As a result, each cross pin fully engages the lower receiver and a portion of one side of each cross pin protrudes into the corresponding pocket. Each pocket and corresponding receiver attach screw shares a common axis that is perpendicular to the bores. The curved neck of the attach screw provides an engagement surface for the corresponding cross pin, which is a line of contact between them. The diameter of the cross pins and the amount of offset of the bores from the pockets are determined so the protruding side of the cross pins closely abuts the curved necks of the attach screws. The toroidal necks have a radius equal to the radius of the bores. The cross pins and the attach screws hold the upper receiver down in the cradle formed by the top 20 of the lower receiver, which provides stability both laterally and against torqueing. As a result, the lower receiver cannot be separated from the upper receiver when a cross pin is present in the bore 90.

Both the cross pins 24 and the attach screws 82 are made of hardened steel in the current embodiment, so minimal wear occurs between them. However, the bores 90 in the aluminum or plastic lower receiver may stretch over time, causing the mating engagement between the upper receiver and the lower receiver to loosen. In the event such undesirable loosening occurs, the cross pins are removed to detach the lower receiver, the receiver attach screws are tightened slightly to decrease the protrusion amount and adjust the tightness of fit between the upper receiver and the lower receiver, and the cross pins are inserted to reattach the lower receiver. The screwing of the receiver attach screws also exposes a fresh surface of the curved neck to the cross pins, which compensates for any wear which may have occurred between them. The thread pitch of the attach screws is selected to provide a fine adjustment capability: the vertical movement of the attach screws is small relative to the rotational movement. Significant force is required to make the attach screws turn; they do not rotate under impulse forces from discharging the firearm.

The walls in the upper receiver are mechanically sufficient in thickness to engage the threads in attach screws 82 and provide for a strong connection under normal use. In the current embodiment, the walls are more than ¼" thick and the thread is ⅜-16.

FIGS. 5-9 illustrate the structure and function of the child safety lock 112 that is integral to the lower receiver 18. More particularly, the child safety lock is a stepped Allen screw in the current embodiment with a hex socket head 114. The child safety lock is shown in the locked/safe position (the trigger 26 is secured) in FIGS. 5-7 and in the unlocked/unsafe position in FIGS. 8 and 9 (the trigger is free to be pulled). In the current embodiment, the child safety lock is located in a threaded bore 116 in the right side 118 of the lower receiver.

The top rear of the trigger 26 has a radiused ledge 122 that receives the forward end 120 of the child safety lock 112 in the locked position. When the forward end of the child safety lock is received by the radiused ledge of the trigger, the trigger is secured in position and cannot be pulled rearward to discharge the firearm 10. The child safety lock is engaged by turning the child safety lock clockwise three revolutions to advance the forward end of the child safety lock to block the movement of the trigger. The forward end of the child safety lock has a smaller diameter than the threaded portion. Once the forward end is received by the radiused ledge, the wider threaded portion is obstructed by the trigger, which creates a stop point for the child safety lock.

To unlock the child safety lock, the child safety lock is rotated counterclockwise until the head 114 of the child safety lock is flush with the exterior surface 124 of the lower receiver 18. In this position, the radiused ledge 122 of the trigger 26 is in front of the forward end 120 of the child safety lock 112 (which has retracted), and the trigger can be pulled rearward to discharge the firearm 10.

Figure 10:
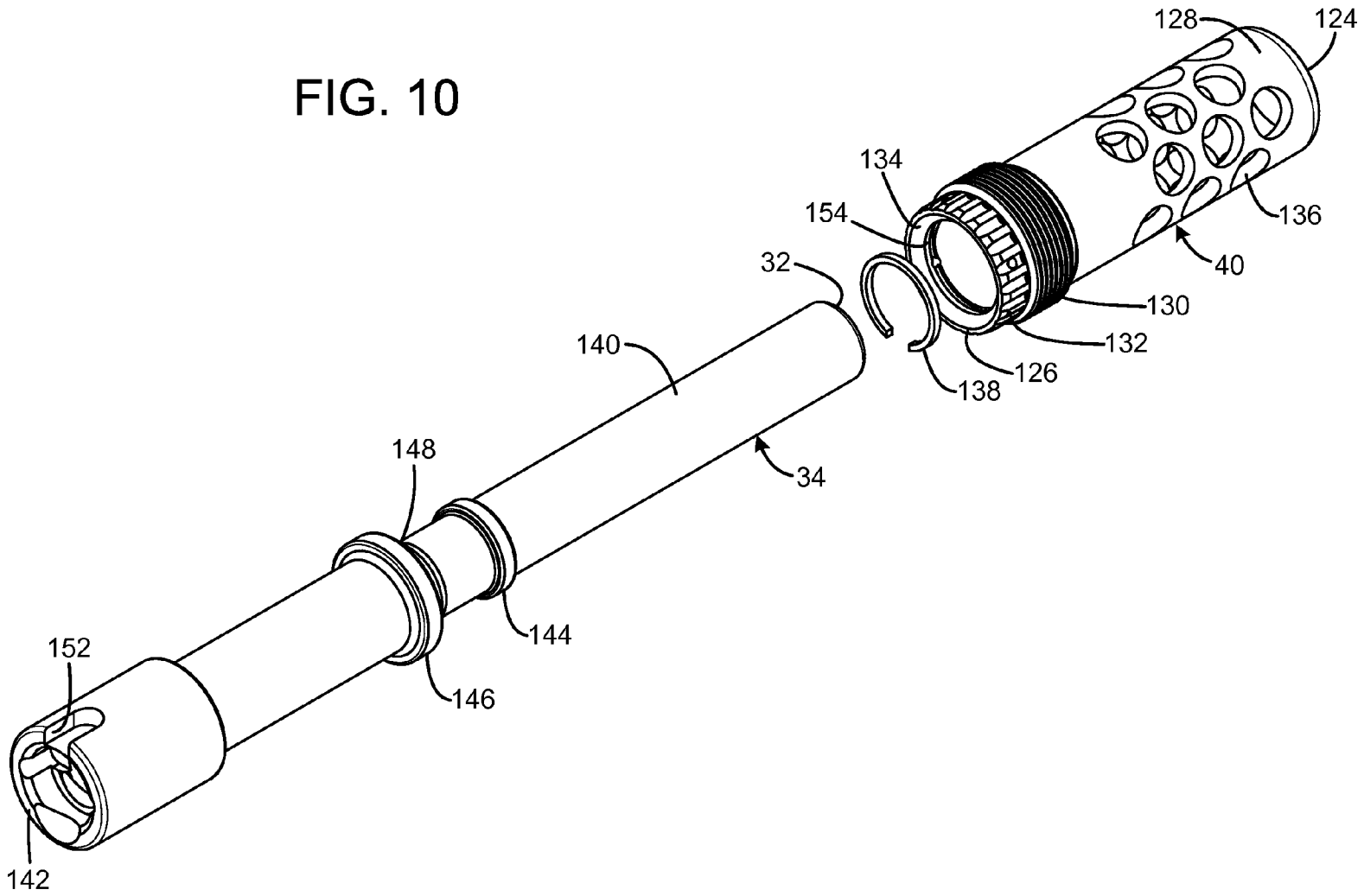
FIG. 10 is a top rear isometric exploded view of the current embodiment of the barrel and barrel nut of FIG. 1 removed from the firearm.
Figure 11:
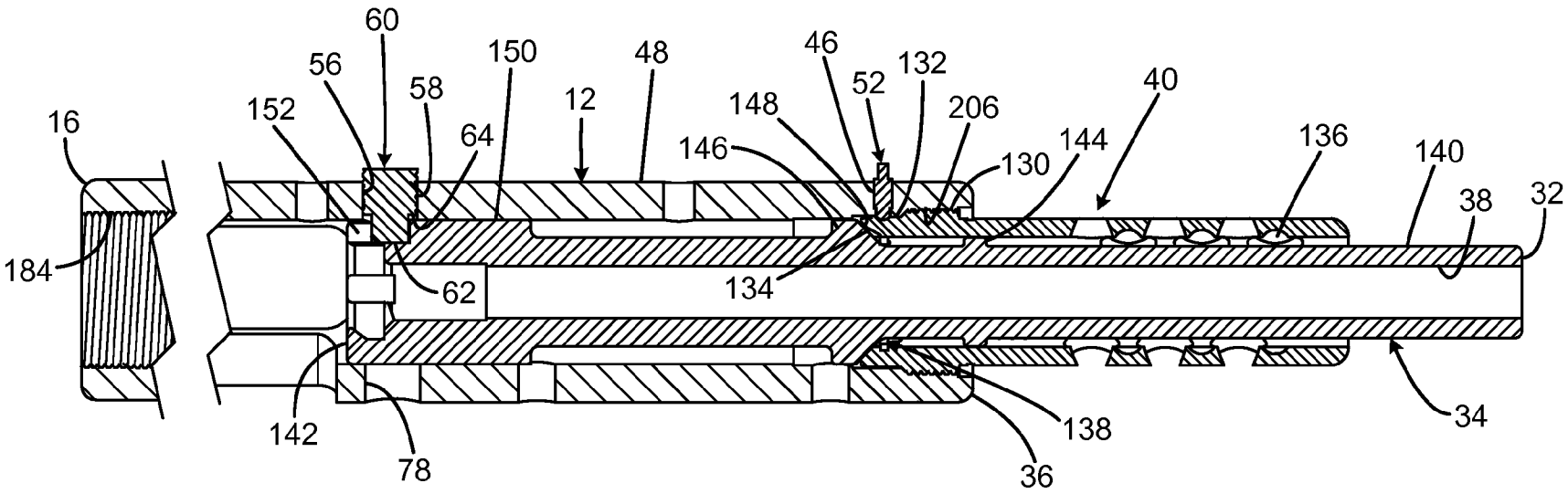
FIG. 11 is a right side partial sectional view of the current embodiment of the upper receiver, barrel, and barrel nut of FIG. 1 removed from the firearm with the cocking handle secured in a rearward position.
Figure 12:
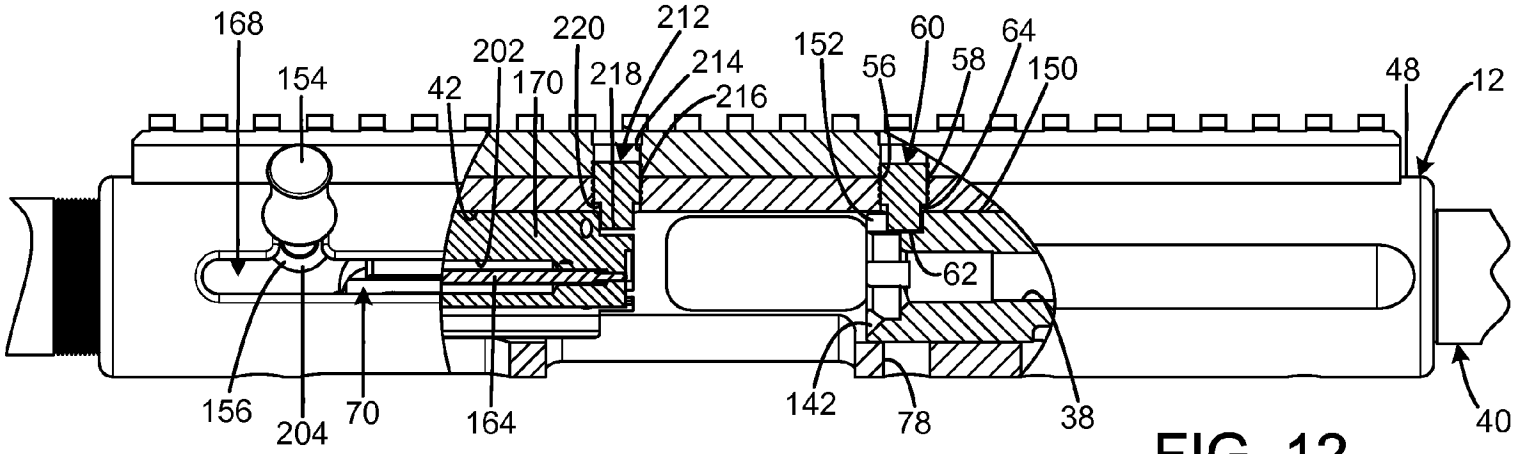
FIG. 12 is a right side partial sectional view of the current embodiment of the upper receiver, barrel, and barrel nut of FIG. 1 removed from the firearm with the cocking handle in the locked position.
Figure 13:
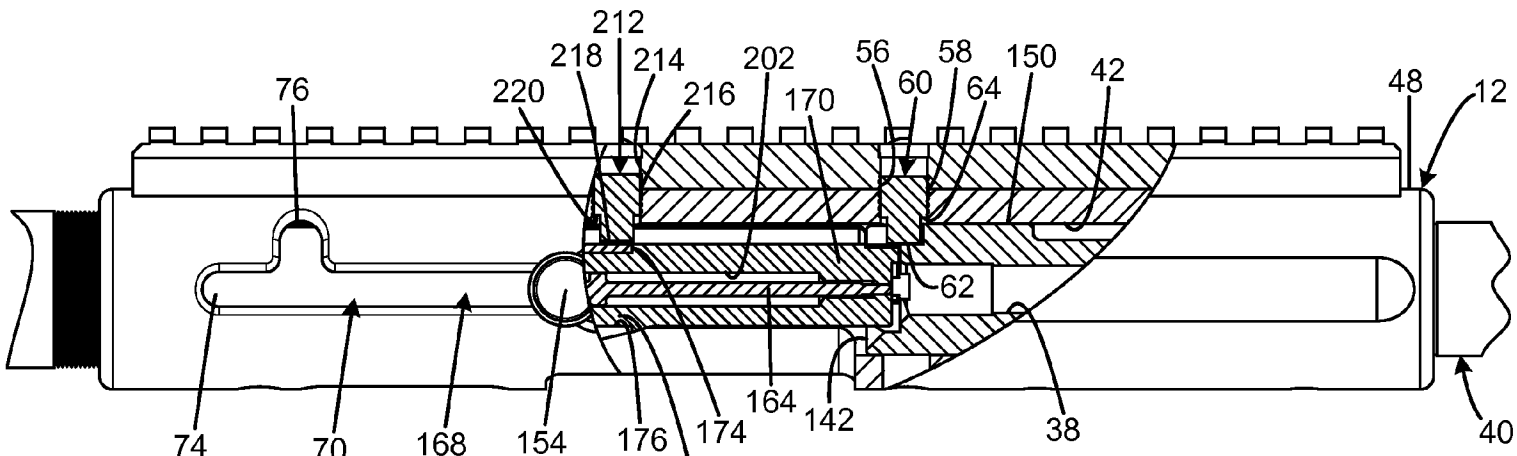
FIG. 13 is a right side sectional view of FIG. 12 with the bolt in the forward firing position.
Figure 14:
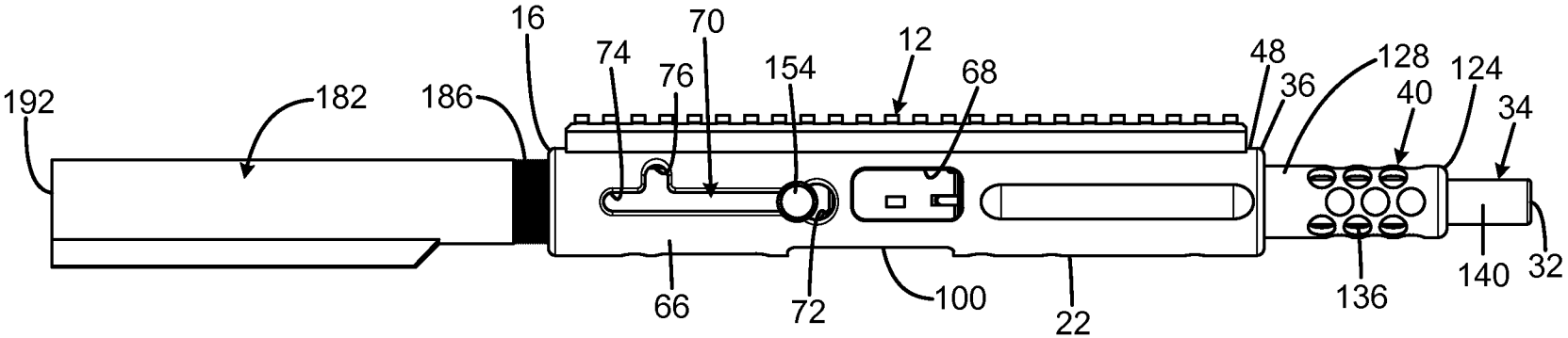
FIG. 14 is a right side view of the current embodiment of the upper receiver, barrel, barrel nut, and butt stock tube of FIG. 1 removed from the trigger housing with the barrel nut fully tightened.
Figure 15:
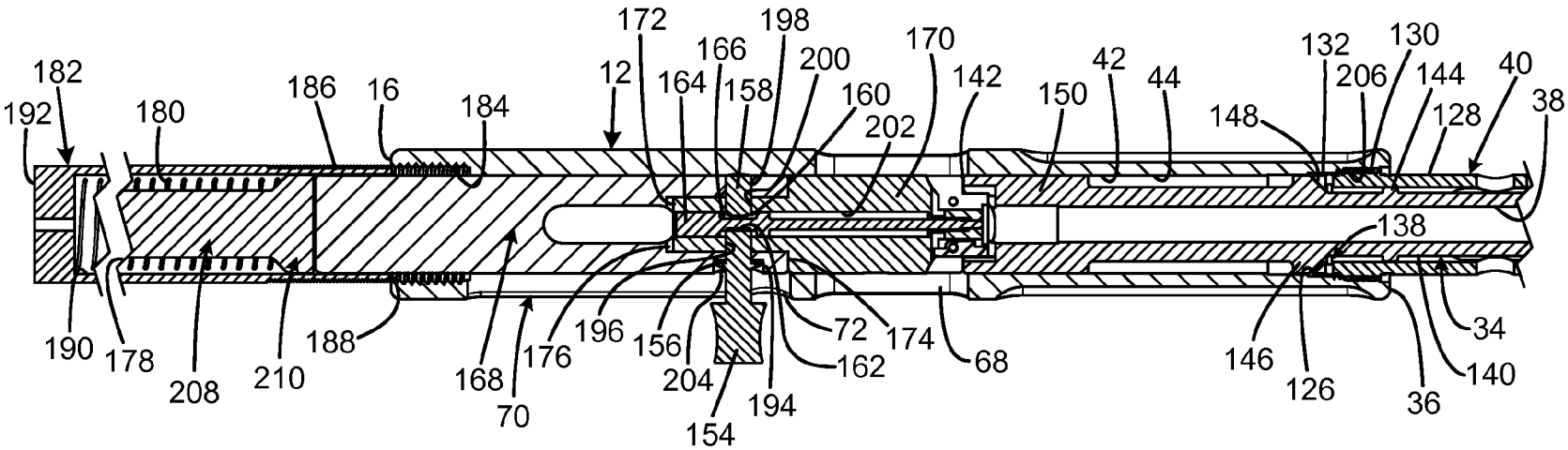
FIG. 15 is a top sectional view of FIG. 14.

FIGS. 10-11 illustrate how the barrel 34 and barrel nut 40 engage with the upper receiver 12.

More particularly, the barrel 34 has a muzzle 32, a rear 142, an exterior 140, and a central bore 38. The rear of the barrel forms a rear bushing 150 having a larger diameter than the majority of the barrel. A slot 152 is present in the rear of the rear bushing. The exterior of the barrel forms a rear flange 146 in front of the rear bushing. The rear flange has the same enlarged diameter as does the rear bushing. The rear flange has a forward tapered surface 148. The exterior of the barrel also forms a forward flange 144 in front of the rear flange. The forward flange has a larger diameter than the majority of the barrel, but has a smaller diameter than both the rear bushing and the rear flange.

The barrel nut 40 has a front 124, a rear 126, an exterior 128, and a central bore 154.

Indentations 136 are formed by the exterior at the front of the barrel nut. The rear of the barrel nut forms a tapered surface 134. The rear of the exterior of the barrel nut forms a plurality of teeth 132 and threads 130 that are positioned immediately in front of the teeth 132.

The diameters of the rear bushing 150 and the rear flange 146 are sized to closely fit the central bore 42 of the upper receiver 12 and slip fit against the interior surface 44 for lateral alignment. The two mounting points (the rear bushing and the rear flange) are offset by four inches in the current embodiment, which provides for greater rigidity and bore 38 alignment with the upper receiver 12. The tapered surface 134 of the rear 126 of the barrel nut 40 is an internal taper that corresponds to the external tapered surface 148 on the front of the rear flange of the barrel 34. The external threads 130 on the barrel nut correspond to the internal threads 206 at the front 36 of the central bore of the upper receiver. The forward flange 144 engages a barrel nut retainer 138 to capture the rear 126 of the barrel nut on the barrel.

When the barrel 34 is installed in the upper receiver 12, the rear bushing 150 is inserted into the central bore 42 with the slot 152 aligned with the forward portion 62 of the barrel stop 60. The barrel stop sets the depth of the barrel within the upper receiver and ensures the correct rotational position of the barrel. As the barrel nut 40 is tightened, the tapered surface 134 on the barrel nut interacts with the tapered surface 148 on the front of the rear flange of the barrel to center the barrel for accuracy repeatability. The conical chamfered surfaces 134, 148 eliminate the need for a tight fit between the barrel nut and rear flange. An audible clicking is heard as the forward portion 54 of the barrel nut detent 52 rides over the teeth 132 of the barrel nut as the barrel nut is tightened completely. The threads 130 on the barrel nut engage the threads 206 at the front 36 of the central bore of the upper receiver. The barrel nut detent and teeth prevent the barrel nut from unintentionally loosening. The indentations 136 are located on a portion of the barrel nut that remains outside of the upper receiver and free of the barrel to provide the user with a suitable location to firmly grip the barrel nut to tighten and loosen it.

FIGS. 12-15 illustrate how the cocking handle 154 is retained within the cocking handle slot 70 when the barrel nut 40 is fully tightened. More particularly, the rear 16 portion of the central bore 42 of the upper receiver 12 receives a bolt carrier 168 with a removable bolt head 170. The bolt carrier is continuously urged forward by a bolt return spring 180 that encircles the rear 178 of a buffer 208. The bolt return spring and buffer reside in a cavity 190 in the front 188 of the butt stock tube 182. The front of the butt stock tube is removably secured to the rear of the upper receiver by the engagement of threads 186 on the butt stock tube with the threads 184 on the interior surface 44 of the upper receiver. The rear 192 of the butt stock tube captures the bolt return spring.

The bolt return spring 180 is needed to cycle the action since the firearm 10 is self-loading. Because the rifle is lightweight, the spring also requires a buffer 208, or extra weight. In the current embodiment, the buffer 208 is a steel tube that rides inside the butt stock tube 182 with an enlarged portion 210 in front of the bolt return spring. However, the buffer can also be made of aluminum or plastic. The buffer provides a bearing surface against which the bolt return spring can work the bolt carrier 168 and bolt head 170. When the rifle is discharged, the bolt carrier and bolt head cycle back into the butt stock tube, compressing the bolt return spring. Once the energy of that action has been absorbed by compressing the bolt return spring, the bolt return spring then uses the stored energy to push the buffer, bolt carrier, and bolt head forward into the forward position.

Initially, the cocking handle 154 is pulled rearward to charge the firearm 10, and then released to fly forward responsive to the urging of the bolt return spring 180 to chamber a round. Forward movement of the bolt carrier 168 and bolt head 170 into the forward position is limited by the rear 142 of the rear bushing 150 of the barrel 34. The bolt carrier and bolt head can also be secured in a rearward position by lifting the cocking handle upward into the upward opening 76 of the cocking handle slot 70.

When the cocking handle 154 is lifted upward into the upward opening 76 of the cocking handle slot 70, the bolt carrier 168 and bolt head 170 are also held back by the engagement of the front of the bolt head with a bolt stop 212 to prevent wear on the upper receiver 12. The bolt stop also keeps the bolt carrier and bolt head in rotational alignment during operation of the firearm 10. A threaded portion 216 of the bolt stop is threadedly received by a threaded bore 214 in communication with the central bore 42 of the upper receiver. The bore 214 is located at the top 48 of the upper receiver about 2 inches rearward of the bore 56. The bolt stop has a forward portion 218 that is of a smaller diameter than the threaded portion, which creates a shoulder 220. At least a portion of the forward portion penetrates the central bore. The amount of the forward portion that enters the central bore is determined by the extent to which the bolt stop is screwed into the threaded bore. In the current embodiment, the bolt stop is made of hardened steel to prevent wear, and the bores 56, 214 are ⅜"-16.

The bolt head 170 has a narrow rear portion 172 that is received within a cavity 176 in the front 174 of the bolt carrier. The bolt head has a central bore 202 that receives a firing pin 164. The firing pin has a cutout 166 that receives the forward portion 160 of a firing pin retainer 158 and the forward portion 162 of the cocking handle 154. The firing pin retainer is inserted through an aperture 198 in the bolt carrier and an aperture 200 in the bolt head. The firing pin retainer both helps attach the bolt head to the bolt carrier and limits the travel of the firing pin when in use. The cocking handle has a circular flange 156 that is inserted into an aperture 194 in the bolt carrier, and the forward end of the cocking handle is inserted through an aperture 196 in the bolt head. The forward end of the cocking handle also helps attach the bolt head to the bolt carrier. The bolt carrier and bolt head are sized to closely fit the interior surface 44 of the central bore 42 of the upper receiver, which retains the firing pin retainer and the forward portion of the cocking handle within the bolt carrier bolt head. However, the bolt carrier and bolt head are still free to slide longitudinally within the central bore of the upper receiver. In the current embodiment, the firing pin retainer and cocking handle are made of hardened steel to prevent wear.

The circular flange 156 retains the cocking handle within the cocking handle slot 70. The circular flange has a diameter that is larger than the width of the cocking handle slot except for the forward portion 72 that is enlarged and curved. The outer surface 204 of the circular flange is curved to match the interior surface 44 of the central bore 42 in the upper receiver 12. When the barrel nut 40 is fully tightened, the bolt carrier 168 and bolt head 170 are held rearward by the rear 142 of the rear bushing 150 of the barrel 34. In this position, the circular flange on the cocking handle 154 is not axially registered with the forward portion of the cocking handle slot, which prevents the removal of the cocking handle from engagement with the cocking handle slot, bolt carrier, and bolt head.

In the current embodiment the cocking slot width is 0.26" wide. The diameter of the forward position is 0.5" in diameter. The wall thickness of the upper receiver is 0.25". The internal diameter of the receiver tube is 0.98". The cocking handle has a retention flange that is of a matching convex radius to the inside diameter of the receiver. The shape of the retention flange allows the flange to be held in place in the firearm during operation without damaging the inside of the receiver. The diameter of this flange is slightly smaller than the clearance hole in the receiver slot track so as to fit through it during assembly/disassembly.

Figure 16:
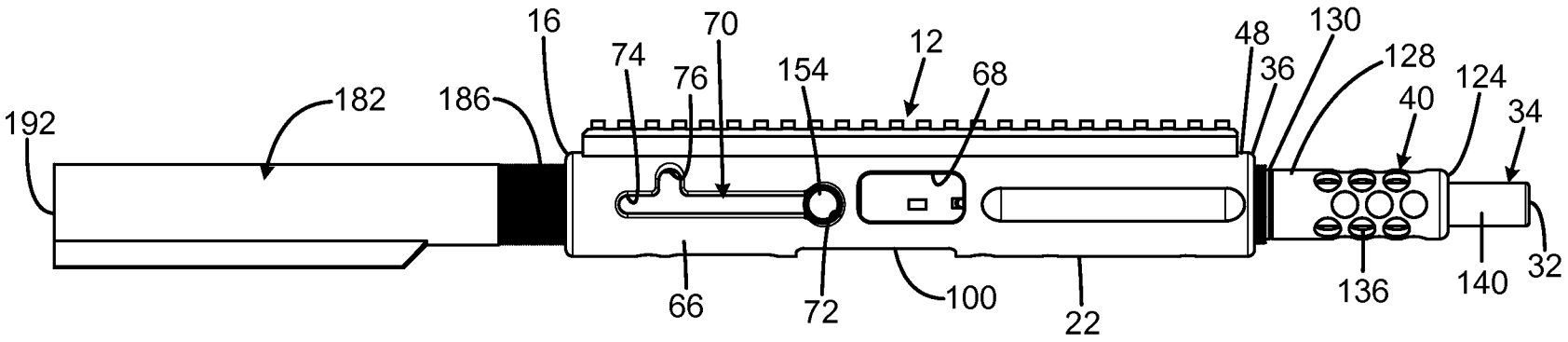
FIG. 16 is a right side view of the current embodiment of the upper receiver, barrel, barrel nut, and butt stock tube of FIG. 1 removed from the firearm with the barrel nut partially loosened. At this location, the cocking handle is in alignment with the clearance hole in the receiver and can be removed from the firearm.
Figure 17:
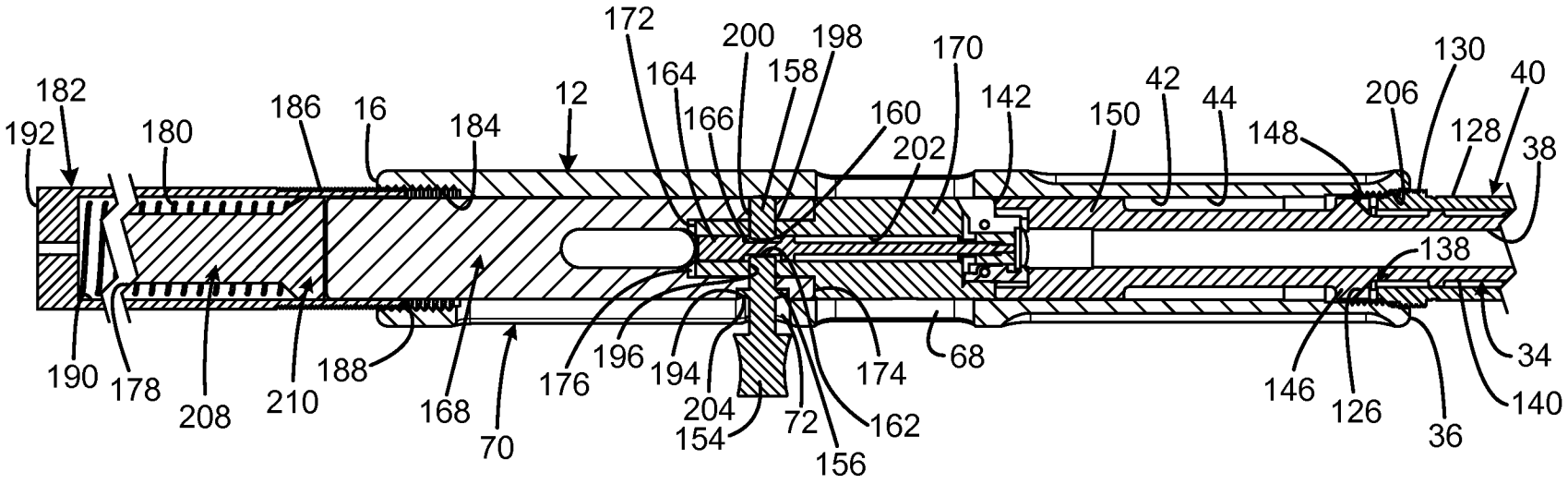
FIG. 17 is a top sectional view of FIG. 16.

FIGS. 16-17 illustrate how the cocking handle 154 can be aligned for removal from the cocking handle slot 70 when the barrel nut 40 is loosened sufficiently. More particularly, as the barrel nut 40 is loosened, the bolt return spring 180 is able to urge the bolt carrier 168 and bolt head 170 further forward. Once the barrel nut is sufficiently loosened, the circular flange 156 on the cocking handle 154 is axially registered with the forward portion 72 of the cocking handle slot 70. In that position, the cocking handle can be withdrawn from the bolt carrier and bolt head, which enables removal of the bolt carrier and bolt head once the barrel nut is fully loosened and the barrel 34 is removed from the upper receiver 12. The bolt head can subsequently be detached from the bolt carrier by removal of the firing pin retainer 158, and a replacement bolt head with a different caliber can be attached. The firearm 10 can then be reassembled with a suitable barrel with a caliber that matches the replacement bolt head.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a compact survival firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Although attachment screws located in the upper receiver and cross pins located in the lower receiver have been described, it should be appreciated that the attachment screws could be positioned in the lower receiver and the cross pins could be positioned in the upper receiver.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm with removable barrel comprising:

a frame defining a passage having a forward open aperture and having a frame threaded portion;

a barrel having a breech end portion received in the frame, and having a forward portion extending forward of the aperture;

the barrel having a rear end support portion adapted to be closely received in the frame passage such that is the rear end support portion laterally constrained by the frame;

a barrel nut having a nut threaded portion adapted to removably engage the frame threaded portion;

the barrel nut having a tapered nut portion;

the barrel having an intermediate support portion spaced apart from the rear end support portion and having a tapered barrel portion adapted to engage the tapered nut portion.

2. The firearm of claim 1 wherein the rear end support portion and the intermediate support portion are spaced apart by at least four inches.

3. The firearm of claim 1 wherein the rear end support portion and the intermediate support portion are spaced apart by an elongated necked-down portion of the barrel having a smaller diameter than the rear end support portion and the intermediate support portion.

4. The firearm of claim 1 wherein the passage is a cylindrical bore and the rear end support portion is a cylinder sized to be closely received by the cylindrical bore.

5. The firearm of claim 1 wherein the frame includes a key feature, and the rear end of the barrel includes a mating feature operable to mate with the key feature to constrain the barrel to a repeatable rotational orientation with respect to the frame.

6. The firearm of claim 1 wherein the tapered nut portion and tapered barrel portion are adapted to mate with each other to repeatably center the barrel with respect to the passage.

7. The firearm of claim 6 wherein the tapered portions are conical.

8. The firearm of claim 6 wherein the intermediate support feature is a flange, and wherein a rearward facing surface of the flange is tapered.

9. The firearm of claim 6 wherein the forward portion of the passage is internally tapered.

10. The firearm of claim 1 wherein the intermediate support feature is a flange, and wherein a rearward facing surface of the flange is tapered.

11. The firearm of claim 1 wherein the intermediate support portion of the frame is at a forward end of the frame.

12. The firearm of claim 1 wherein the frame threaded portion is proximate to the intermediate support portion of the frame.

13. The firearm of claim 12 wherein the barrel nut defines a nut bore operable to receive a portion of the barrel forward of the intermediate support feature.

14. The firearm of claim 13 wherein the barrel nut is an elongated tube.

15. The firearm of claim 14 wherein the barrel nut defines a plurality of apertures, such that the barrel nut is operable to provide a ventilated shroud about the barrel.

16. The firearm of claim 13 wherein the barrel nut bore loosely receives the barrel.

17. A barrel for a firearm comprising:

a breech end portion having a cylindrical exterior with a first diameter;

a necked-down portion forward of the breech end portion having a second diameter less than the first diameter;

a flange portion forward of the necked down portion and having a third diameter greater than the second diameter;

a forward portion forward of the flange portion having a fourth diameter less than the third diameter; and the flange having a forward facing surface having a tapered profile, such that when the rear end portion is closely received in a firearm frame passage, and the forward facing surface is engaged by a barrel nut threaded to a threaded portion of the firearm frame, the barrel is repeatably positioned with respect to the frame.

18. The barrel of claim 17 wherein the tapered profile is conical.

19. The barrel of claim 17 wherein the barrel includes a mating feature operable to mate with a key feature of a firearm frame to constrain the barrel to a repeatable rotational orientation with respect to the frame.

* * * * *